US007253368B1

(12) United States Patent
Chou

(10) Patent No.: US 7,253,368 B1
(45) Date of Patent: Aug. 7, 2007

(54) PIN ANCHORING STRUCTURE FOR BUTTON SWITCHES

(75) Inventor: Chin-Wen Chou, Hsin-Tien (TW)

(73) Assignee: Zippy Technology Corp., Hsin-Tien (TW)

( * ) Notice: Subject to any disclaimer, the term of this patent is extended or adjusted under 35 U.S.C. 154(b) by 0 days.

(21) Appl. No.: 11/389,068

(22) Filed: Mar. 27, 2006

(51) Int. Cl.
*H01H 50/56* (2006.01)

(52) U.S. Cl. ..... 200/284; 200/406

(58) Field of Classification Search ..... 200/284, 200/406, 512–521, 276, 276.1, 329, 341
See application file for complete search history.

(56) References Cited

U.S. PATENT DOCUMENTS

| | | | | | |
|---|---|---|---|---|---|
| 3,941,964 | A * | 3/1976 | Yoder | 200/516 |
| 4,207,448 | A * | 6/1980 | Furusawa et al. | 200/516 |
| 4,263,485 | A * | 4/1981 | Corwin | 200/5 A |
| RE30,923 | E * | 5/1982 | Durkee et al. | 200/5 A |
| 4,598,181 | A * | 7/1986 | Selby | 200/5 A |
| 4,659,881 | A * | 4/1987 | Dowe | 200/5 R |
| 4,803,321 | A * | 2/1989 | Lefebvre | 200/517 |
| 5,313,027 | A * | 5/1994 | Inoue et al. | 200/5 A |
| 6,107,586 | A * | 8/2000 | Takeuchi et al. | 200/535 |
| 6,259,046 | B1 * | 7/2001 | Iwama et al. | 200/5 A |
| 6,548,779 | B2 * | 4/2003 | Takahashi et al. | 200/516 |
| 6,670,566 | B1 * | 12/2003 | Wang | 200/406 |
| 6,683,265 | B2 * | 1/2004 | Masuda | 200/406 |
| 2002/0017449 | A1 * | 2/2002 | Takahashi et al. | 200/516 |
| 2005/0279619 | A1 * | 12/2005 | Kurokawa et al. | 200/512 |

FOREIGN PATENT DOCUMENTS

| | | |
|---|---|---|
| TW | 570279 | 1/2004 |
| TW | 570281 | 1/2004 |
| TW | M248006 U | 10/2004 |

* cited by examiner

*Primary Examiner*—K. Lee
*Assistant Examiner*—Lisa Klaus
(74) *Attorney, Agent, or Firm*—Birch, Stewart, Kolasch & Birch, LLP

(57) ABSTRACT

A pin anchoring structure for button switches has a wiring space in an insulation seat to hold a first pin and a second pin that are separated. Through a pressing action, the first pin and the second pin form an electric connection via a conductive connection member. The second pin has a pressed coupling section which is formed in a bulged curve. The seat has a bottom which also is formed in another bulged curve corresponding to the pressed coupling section. Thereby the second pin can be anchored securely on the bottom of the seat.

2 Claims, 5 Drawing Sheets

PIN ANCHORING STRUCTURE FOR BUTTON SWITCHES

FIELD OF THE INVENTION

The present invention relates to a button switch and particularly to a pin anchoring structure for button switches.

BACKGROUND OF THE INVENTION

Multi-instruction switches are widely used in various types of information appliance (IA) products such as mobile phones, PDAs, computer keyboards and the like. The multi-instruction switch can provide multiple stages connection and generate multiple sets of circuit signals. Hence one switch can execute multiple actions to reduce the size of IA products. It is more convenient in use.

R.O.C. patent No. M248006 entitled "Thin switch" includes a seat which has a hollow housing compartment with an opening directing upwards. The housing compartment has an electrode portion and an elastic element located above the electrode portion. The elastic element includes a trigger assembly which contains an upper button and a lower button. A cap is provided and mounted onto the seat to seal housing compartment. The cap has an opening to allow the upper button to extend outside. Its main features include: the upper button has a bracing portion confined in the housing compartment and a coupling trough. The lower button has a pressure receiving portion anchored in the coupling trough without extending outside an anchor area of the coupling trough and a depressing portion located between the pressure receiving portion and an elastic element. Signals are generated by pressing the depressing portion on the elastic element. The elastic element is deformed to contact the electrode portion to form an electric connection.

The present circuit layout in the switch mostly adopts an injection process to embed pins in a switch body. Due to the function of the IA products grows constantly, a single switch has to generate signals of multiple functions. For instance, the multi-directional trigger switch disclosed in R.O.C. patent No. 570281 generates and outputs a plurality of different signals from one switch body. The circuit layout to embed multiple pins via the injection process at the same time is difficult. R.O.C. patent No. 570279 discloses a rotary switch which adopts a design to separately connect the second pin that is most difficult to be included in the circuit layout. But the second pin has to be bent to form a pressed coupling section located in the switch body and a pin section located outside the switch body. As the total size of the switch is small, and the pins are even smaller, anchoring the second pin is difficult during fabrication. An incidental impact to the second pin could occur during fabrication and cause excessive bending of the second pin. As a result, the pressed coupling section could be warped and a mistaken signal could be generated from the second pin.

SUMMARY OF THE INVENTION

The primary object of the present invention is to solve the aforesaid disadvantages. The invention provides a pin anchoring structure for button switches to improve the problem of difficult anchoring of the second pin of a button switch on an insulation seat of the button switch. The pin and the seat have mating shapes to confine the movement of the pin. Hence the second pin can be anchored as desired because of the shape of the seat during assembly.

To achieve the foregoing object, the second pin on the insulation seat of the button switch includes a pin section embedded in the seat and a pressed coupling section located in the switch. Through a pressing action the second pin and the first pin of the switch are electrically connected via a conductive connection element. The pressed coupling section and the switch body corresponding to the pressed coupling section has a bottom that are formed in a bulged curve so that the pressed coupling section of the second pin can be anchored securely on the bottom.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
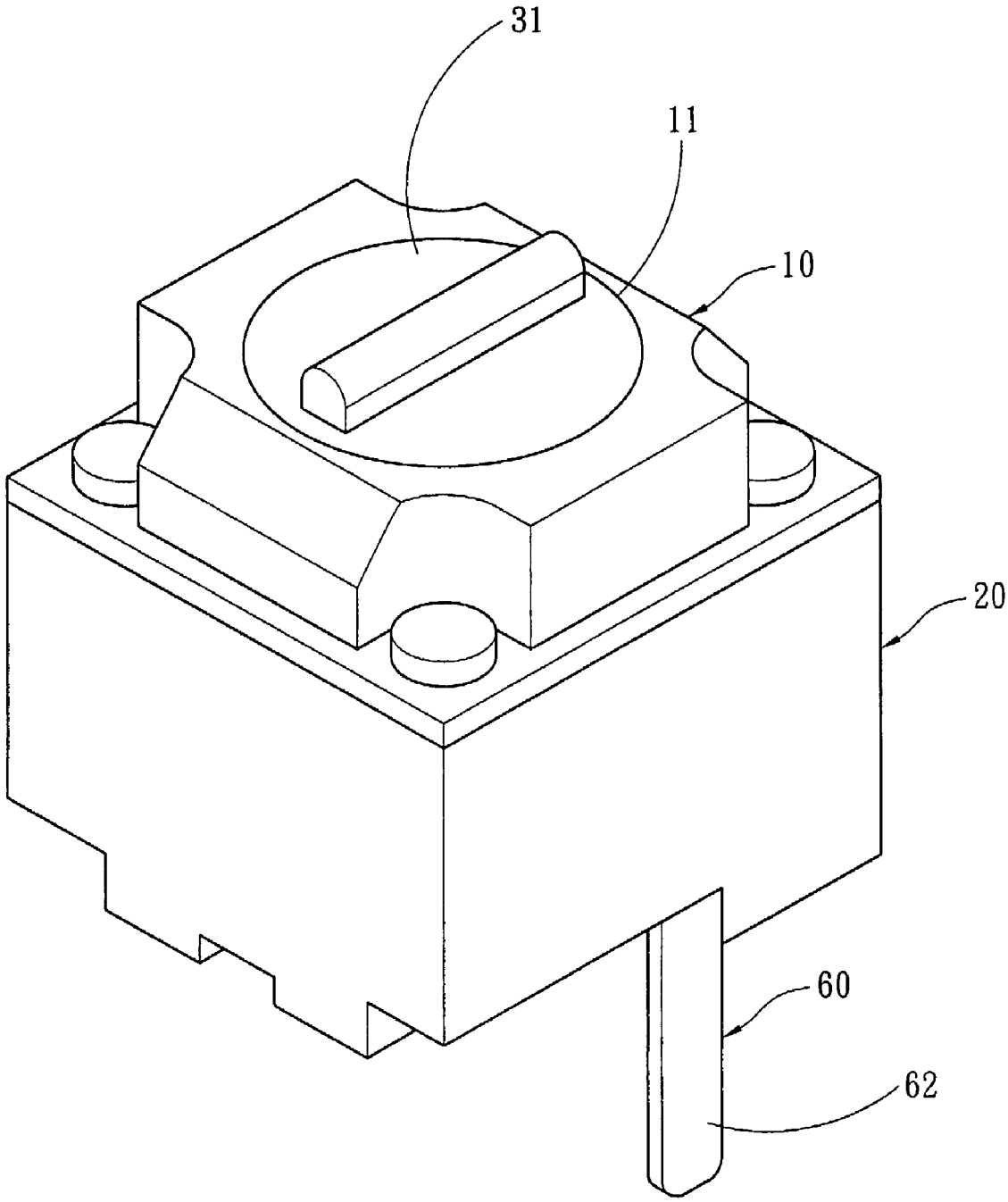
FIG. 1 is a perspective view of the invention.
Figure 2:
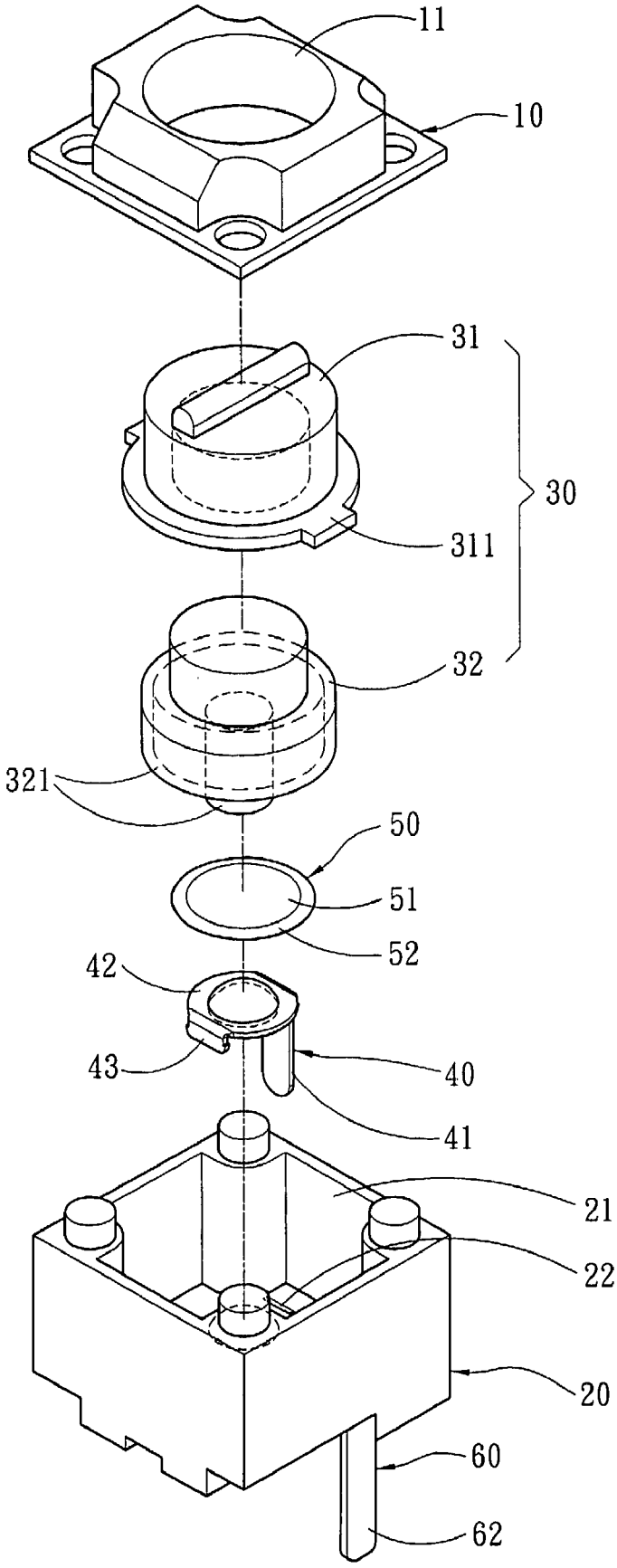
FIG. 2 is an exploded view of the invention.

Please refer to FIGS. 1 and 2, the invention is a button switch which has a switch body consisting of a cap 10 and a seat 20 to form a wiring space 21 in the interior to embed a first pin 60 and a second pin 40 through an injection process. The pins 60 and 40 are bent to form respectively a pin section 41 and 62 that are spaced from each other and anchored on the switch body. The seat 20 has holding apertures 22 corresponding to the pin sections 41 and 62. The pin sections 41 and 62 are extended outside the switch body to connect an external signal source. In the wiring space 21, there are pressed coupling section 42 and 61 located on the surface of the seat 20. The invention has features as follow: the pressed coupling section 42 of the second pin 40 and the switch body corresponding to the pressed coupling section 42 are formed respectively in a bulged curve so that the second pin 40 can be confined in the switch body.

In addition, the cap 10 has an opening 11 to hold a depressing member 30. The depressing member 30 and the pins are interposed by a conductive connection member 50. The conductive connection member 50 may be a dome elastic reed with a contact portion 52 on the periphery to form an electric connection with the pressed coupling section 61 of the first pin 60 in normal conditions, and an arched dome 51 in the center straddling the second pin 40. In an embodiment of the invention, when the depressing member 30 does not receive an external force, it rests on the dome 51 under the gravity force. The depressing member 30 has a detent portion 311 to be confined by the dome 51 and the cap 10 in the wiring space 21 without escaping the switch body.

Figure 3A:
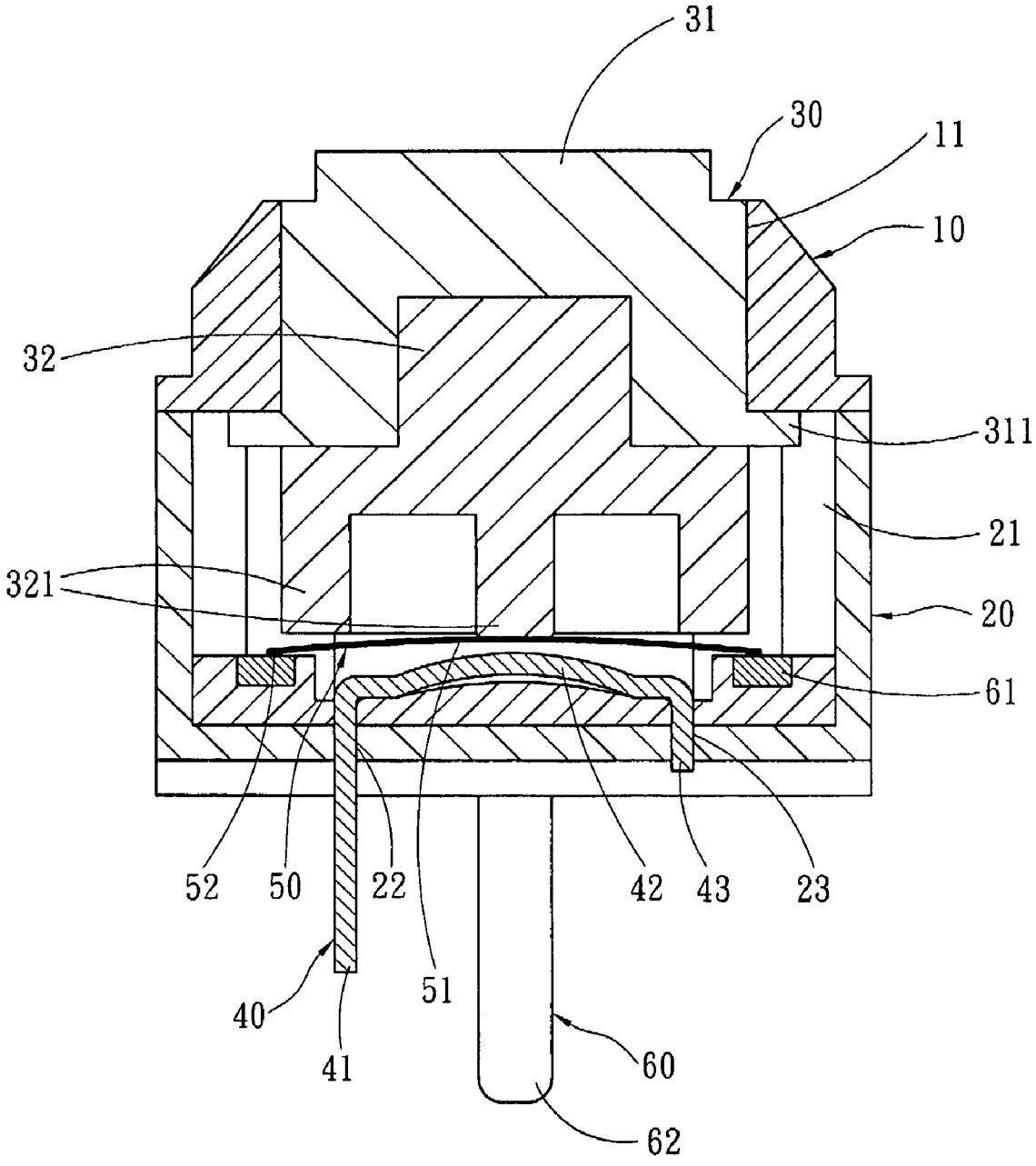
FIGS. 3A and 3B are schematic views of the invention in operating conditions.
Figure 3B:
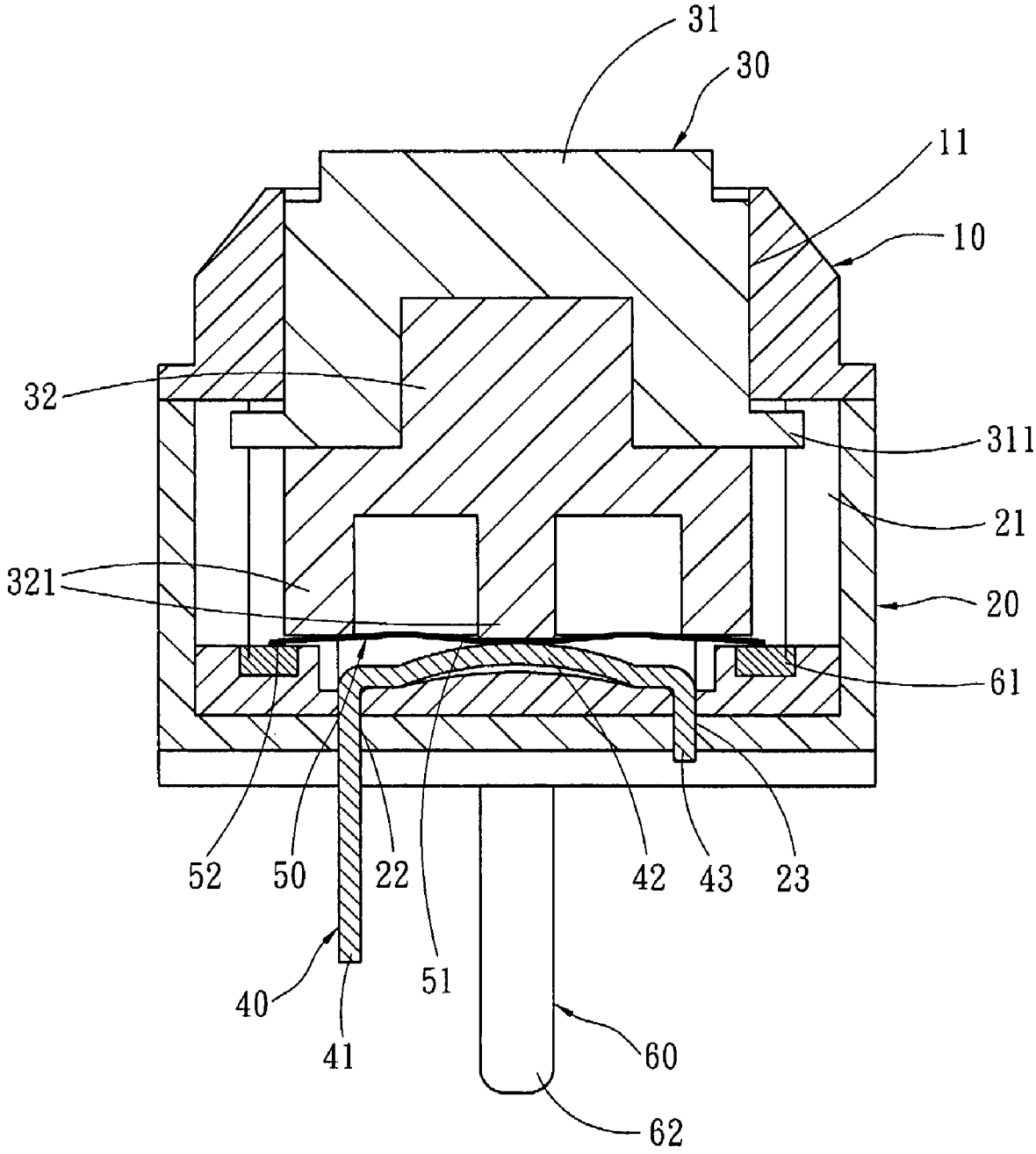

Referring to FIGS. 3A and 3B, when the invention is in use, the depressing member 30 receives a pressing action to move up and down. The pressing action is directly applied on a button 31 located thereon. The button 31 holds a bucking stub 32 which compresses the conductive connection member 50 under pressure. FIG. 3A shows the button switch in a condition before receiving the pressing action. FIG. 3B shows the pressing action pushes the button 31 downwards and the bucking stub 32 compresses the conductive connection member 50. The bucking stub 32 has a compression end 321 to compress the dome 51 and the contact portion 52. When the bucking stub 32 is pressed by the button 31 the compression end 321 firmly compresses the contact portion 52 of the conductive connection member 50 on the pressed coupling section 61 of the first pin 60 and the dome 51 to create a deformation to connect another pressed coupling section 42 of the second pin 40. Hence the pressed coupling sections 42 and 61 of the second pin 40 and the first pin 60 can form a steady electric connection at each pressing action. Namely the second pin 40 and the first pin 60 are electrically connected through the conductive connection member 50 to generate a signal. When the depressing member 30 does not receive the external force, it is bounced back to the original position because the conductive connection member 50 returns to its original shape. Meanwhile, electric connection between the first pin 60 and the second pin 40 is released. Such a design can shrink the button switch to a smaller size. The pins 40 and 60 are embedded by injection process. The pressed coupling section 42 of the second pin 40 and the corresponding portion of the seat 20 are formed in a bulged curve so that they can be held securely in the seat 20 without moving horizontally. Moreover, when the dome 51 is pressed and deformed, the distance between the conductive connection member 50 and the second pin 40 becomes smaller. The dome 51 can be in contact with the pressed coupling section 42 of the second pin 40 to form the electric connection without a lot of deformation of the conductive connection member 50. Hence error resulting from the pressing action can be reduced.

Figure 4:
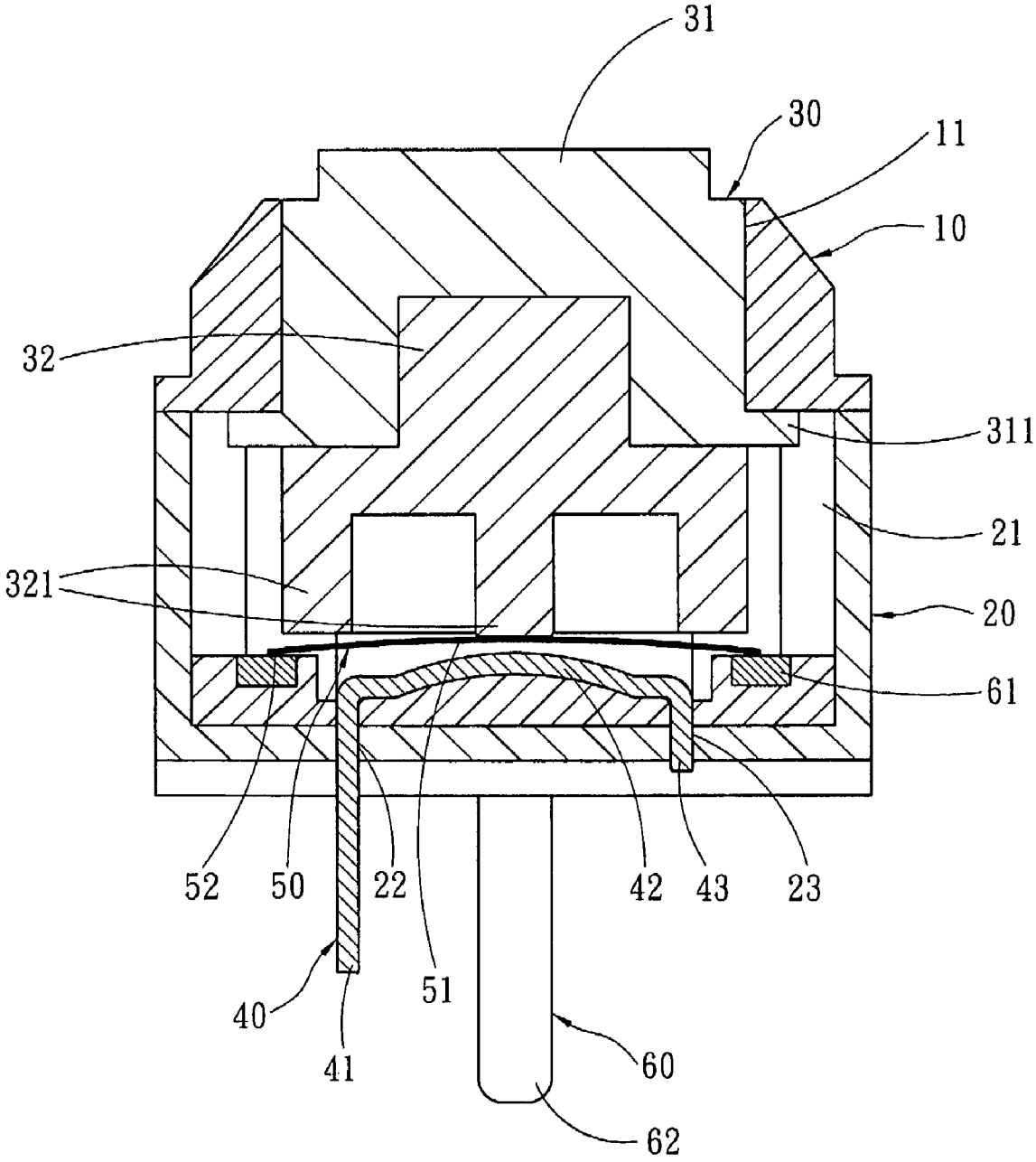
FIG. 4 is a schematic view of another embodiment of the invention.

Refer to FIG. 3A for an embodiment of the second pin 40. The bulged curve of the pressed coupling section 42 of the second pin 40 has a greater curvature than that of the bottom portion of the switch body. Hence the pressed coupling section 42 located on the bulged bottom cannot move horizontally to form a secure anchoring for the second pin 40 on the bottom. Such a design does not limit to matching of the bulged curve of the pressed coupling section 42 and the bottom. FIG. 4 illustrates another embodiment in which the curvature of the pressed coupling section 42 is same as the bottom, and the second pin 40 can be anchored securely on the bottom as well.

Referring to FIGS. 2 and 3A, in order to enhance retaining effect of the second pin 40 on the seat 20, the second pin 40 may have a retaining section 43 to be wedged in a corresponding retaining hole 23 formed on the seat 20. The retaining section 43 is preferably located opposite to the pin section 41 so that two points anchoring is formed to make anchoring of the second pin 40 more secured.

The pin anchoring structure of the invention overcomes the problem of the conventional small button switch that cannot confine the second pin 40 accurately on the seat 20. This problem is especially severe on the multi-instruction button switch due to its many pins on the base. Effective use of the wiring space 21 is more important. If the second pin 40 is not confined and anchored correctly, signal errors often occur. The pin anchoring structure of the invention can provide a desired anchoring effect for the second pin 40 and prevent the pressed coupling section 42 from warping or skewing. With the second pin 40 occupying minimum wiring space 21 and still generating a correct signal, the quality of the switch improves.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A pin anchoring structure for button switches, comprising:

a switch body having a wiring space; and at least a first pin and a second pin located in the switch body, and a conductive connection member which is electrically connected to the first pin in normal conditions and connected to the second pin when subject to a force to generate a signal output;

wherein the switch body has a holding aperture, the second pin having a pin section running through the holding aperture and a pressed coupling section located between the conductive connection member and the bottom of the switch body, the pressed coupling section and the corresponding bottom of the switch body being formed respectively in a bulged curve to facilitate installation of the second pin;

wherein the pressed coupling section of the second pin is extended on another end to form a retaining section, the bottom of the switch body having a retaining hole corresponding to the retaining section; and wherein the curvature of the bulged curve of the pressed coupling section of the second pin is greater than that of the bottom.

2. The pin anchoring structure of claim 1, wherein the curvature of the bulged curve of the pressed coupling section of the second pin is game as that of the bottom.

* * * * *